US007885580B2

(12) United States Patent
Kim et al.

(10) Patent No.: US 7,885,580 B2
(45) **Date of Patent: *Feb. 8, 2011**

(54) IMAGE FORMING APPARATUS, AND DEVELOPING DEVICE AND DEVELOPING UNIT THEREOF

(75) Inventors: Jong In Kim, Suwon-si (KR); Myoung Su Baek, Suwon-si (KR); Oh Dug Gwon, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 230 days.

This patent is subject to a terminal disclaimer.

(21) Appl. No.: 12/205,047

(22) Filed: Sep. 5, 2008

(65) Prior Publication Data

US 2009/0214263 A1 Aug. 27, 2009

(30) Foreign Application Priority Data

Feb. 21, 2008 (KR) ..... 10-2008-0015802
Apr. 4, 2008 (KR) ..... 10-2008-0031765

(51) Int. Cl.
*G03G 15/01* (2006.01)

(52) U.S. Cl. ..... 399/223; 399/258

(58) Field of Classification Search ..... 399/223
See application file for complete search history.

(56) References Cited

U.S. PATENT DOCUMENTS 4,615,608 A 10/1986 Mizutani
4,992,830 A 2/1991 Kohyama
5,402,212 A 3/1995 Ito et al.
6,285,841 B1 * 9/2001 Miho ..... 399/55
2001/0021322 A1 9/2001 Tsuruya et al.
2003/0152396 A1 8/2003 Yasui et al.
2004/0184838 A1 9/2004 Ikeda et al.
2005/0158081 A1 7/2005 Tamura

FOREIGN PATENT DOCUMENTS

JP 01-131538 5/1989
JP 01131583 5/1989
JP 2002049209 2/2002
JP 2006-65117 3/2006
JP 2007-121555 5/2007
JP 2007249151 9/2007

OTHER PUBLICATIONS

Russian Office Action issued Nov. 20, 2009 in RU Application No. 2008138094.
European Search Report issued Mar. 31, 2010 in EP Application No. 09150918.2.
Russian Decision on Grant issued Sep. 21, 2010 in RU Application No. 2008138094/28.

* cited by examiner

*Primary Examiner*—David M Gray
*Assistant Examiner*—Roy Yi
(74) *Attorney, Agent, or Firm*—Stanzione & Kim, LLP

(57) ABSTRACT

An image forming apparatus includes developing units designed to have an appropriate developer storage capacity in consideration of developer consumption, and improved convenience of use. The image forming apparatus also includes an image carrier, and plural developing units arranged along a rotating direction of the image carrier to supply developers to the image carrier. The plural developing units include a first developing unit having the largest developer storage capacity and a second developing unit having the second largest developer storage capacity after the first developing unit.

31 Claims, 7 Drawing Sheets

IMAGE FORMING APPARATUS, AND DEVELOPING DEVICE AND DEVELOPING UNIT THEREOF

CROSS-REFERENCE TO RELATED APPLICATIONS

This application claims priority under 35 U.S.C. §119(a) from Korean Patent Application No. 2008-0015802, filed on Feb. 21, 2008, in the Korean Intellectual Property Office and Korean Patent Application No. 2008-0031765, filed on Apr. 4, 2008 in the Korean Intellectual Property Office, the disclosures of which is incorporated herein in their entirety by reference.

BACKGROUND OF THE INVENTION

1. Field of the Invention

The present general inventive concept relates to an image forming apparatus, and a developing device and a developing unit thereof, and, more particularly, to an image forming apparatus having a plurality of developing units to supply developers to an image carrier, and a developing device and a developing unit thereof.

2. Description of the Related Art

Image forming apparatuses to form an image on a printing medium according to an input signal. Examples of image forming apparatuses include printers, copiers, facsimiles, and devices combining functions thereof.

Of a variety of image forming apparatuses, a printing operation of an electro-photographic image forming apparatus is carried out in such a way that an electrostatic latent image is formed on a surface of a photosensitive member, which was charged with a predetermined electric potential, via scanning of light, and developer is supplied to the electrostatic latent image, forming a visible developer image. The developer image, formed on the photosensitive member, is transferred to a printing medium directly or by way of an intermediate transfer member. The transferred image present on the printing medium is fixed to the printing medium via a fixing process.

In the above-described printing operation, note that the developer image, formed on the photosensitive member or the intermediate transfer member, partially remains on the photosensitive member or the intermediate transfer member, rather than being completely transferred to the intermediate transfer member or the printing medium. The resulting remaining waste developer is collected by a cleaning device and is returned into a waste developer storage container.

Generally, the cleaning device includes a cleaning blade to come into contact with a surface of an image carrier, such as the photosensitive member or the intermediate transfer member, by a predetermined pressure. One end of the cleaning blade comes into frictional contact with the surface of the image carrier, to scrape the developer remaining on the surface of the image carrier.

An appropriate amount of developer remaining on the surface of the image carrier does not present a problem. However, where substantially no developer remains on the surface of the image carrier for a warm-up operation of the image forming apparatus, or in the case where only an inappropriately small amount of developer remains on the surface of the image carrier as a result of using a high transfer efficiency printing medium, a large frictional force is exerted between the cleaning blade and the image carrier, overturning the cleaning blade.

Further, even if the cleaning blade is not overturned, an excessively increased frictional force between the image carrier and the cleaning blade results in damage to the cleaning blade or loud frictional noise.

To solve the above-described problems, for example, there has been conventionally proposed a method wherein an image for lubrication is formed on the image carrier during a warm-up period or after printing a page prior to printing a subsequent page in a successive printing operation, so as to reduce friction between the image carrier and the cleaning blade.

However, when the above-described method is applied to a color image forming apparatus having a plurality of developing units, the following problems may occur.

Generally, a color image forming apparatus includes four developing units corresponding to respective colors. Any one of the four developing units is devised to supply a developer to an image carrier not only during a printing operation forming an image on a printing medium, but also during a lubricating operation forming an image for lubrication on the image carrier. The developing unit for lubrication consumes more developer than the other developing units, and thus, naturally has a shorter exchange cycle than other developing units. This forces a user to inconveniently exchange a specific developing unit frequently, and moreover, may cause users, not having advanced knowledge as to an operation of the image forming apparatus, to have a negative opinion thereof.

Another problem is that the color image forming apparatus cannot resume a printing operation until the image for lubrication formed on the image carrier passes all of the developing units downstream thereof. This may result in degradation of printing speed in the case of a successive printing operation.

Furthermore, the image for lubrication formed on the image carrier tends to be deflected toward the developing units arranged downstream thereof while passing through the developing units. This causes contamination of the developing units, resulting in degradation of image quality during a subsequent printing operation.

Meanwhile, there is a problem in that developer supplied to the image carrier for image formation is not completely attached to the image carrier, and partially falls or is scattered, contaminating an interior of the developing unit. In particular, if the residual developer enters a light window of a light scanning device, the developer may cause degradation of image quality during a printing operation.

SUMMARY OF THE INVENTION

The present general inventive concept provides an image forming apparatus, and a developing device and a developing unit thereof, in which a developer storage capacity of respective developing units are appropriately designed in consideration of consumption of developer, achieving improved convenience in use.

The present general inventive concept also provides an image forming apparatus, and a developing device and a developing unit thereof, to prevent degradation of printing speed or contamination of developing units due to an image for lubrication formed on an image carrier.

The present general inventive concept also provides an image forming apparatus, and a developing device and a developing unit thereof, to prevent an interior of a developing unit or a light window of a light scanning device from being contaminated by residual developer, which is scattered rather than being attached to an image carrier, thereby consequently preventing degradation of image quality during a printing operation.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including an image carrier, and plural developing units arranged along a rotating direction of the image carrier, to supply developer to the image carrier, wherein the plural developing units include: a first developing unit having a largest developer storage capacity, and a second developing unit disposed at the farthest downstream side with respect to the rotating direction of the image carrier, the second developing unit having a developer storage capacity smaller than the developer storage capacity of the first developing unit and larger than a developer storage capacity of the remaining developing units.

The image forming apparatus may further include a cleaning unit to remove residual developer present on the image carrier by coming into frictional contact with the image carrier, and the second developing unit may supply the developer to the image carrier, to reduce friction between the image carrier and the cleaning unit.

The image forming apparatus may further include a light scanning device to scan light to the image carrier, the light scanning device may form an electrostatic latent image for lubrication on a surface of the image carrier, and the second developing unit may supply the developer to the electrostatic latent image for lubrication.

The developing units may be arranged parallel and adjacent to one another.

The image carrier may include a photosensitive member having a surface on which an electrostatic latent image and a developer image are formed.

The plural developing units respectively may include photosensitive members each having a surface on which an electrostatic latent image and a developer image are formed, and the image carrier may include an intermediate transfer member to hold a developer image transferred from the respective photosensitive members.

The first developing unit may store black developer.

The second developing unit may store yellow developer.

The developing units respectively may include developing members, and one or more developing units respectively may include carrying portions protruding from the developing members toward the image carrier, to receive the developer therein.

At least one of the carrying portions may have a different protruding length than the remaining carrying portions protruding toward the image carrier.

The carrying portion of the developing unit, disposed at the farthest upstream side with respect to the rotating direction of the image carrier, may protrude the farthest toward the image carrier.

At least one of front surface portions of the carrying portions, which is closest to the image carrier, may be bent upward along the contour of an outer circumferential surface of the image carrier.

The developing units respectively may further include feeding members to supply the developer to the developing members, and the carrying portions respectively may include developer shields provided along a longitudinal direction of the developing members, each developer shield having one side fixed to the corresponding carrying portion and the other side adjacent to one of the corresponding developing and feeding members.

The developer shields may be tilted toward the rotating direction of the developing members.

The developer may be supplied to the image carrier by a feeding angle that is an acute angle relative to a horizontal plane.

At least one of the developing units may be tilted by the feeding angle, to supply the developer by the feeding angle.

The feeding angle may be less than half of an angle of repose of the developer.

The angle may be substantially 10 degrees.

The foregoing and/or other aspects and utilities of the general inventive concept may also be achieved by providing an image forming apparatus including a photosensitive member, a light scanning device to scan light to the photosensitive member so as to form an electrostatic latent image; and plural developing units arranged along a rotating direction of the photosensitive member, wherein the plural developing units include a first developing unit including a developer storage portion having a first volume, a second developing unit including a developer storage portion having a second volume less than the first volume, and at least one third developing unit including a developer storage portion having a third volume less than the second volume, and the second developing unit is disposed at the farthest downstream side with respect to the rotating direction of the photosensitive member.

The first developing unit, the second developing unit and the at least one third developing unit may be arranged parallel and adjacent to one another.

The image forming apparatus may further include a cleaning unit to remove residual developer present on the photosensitive member by coming into frictional contact with the photosensitive member, the light scanning device may form an electrostatic latent image for lubrication on the photosensitive member, and the second developing unit may supply the developer to the electrostatic latent image for lubrication to form a developer image for lubrication, thereby reducing friction between the photosensitive member and the cleaning unit.

The image forming apparatus may further include an intermediate transfer belt to hold an image transferred from the photosensitive member, and a cleaning unit to remove residual developer present on the intermediate transfer belt by coming into frictional contact with the intermediate transfer belt.

One or more developing units of the first, second and third developing units respectively include carrying portions protruding toward the image carrier to receive residual developer not attached to the photosensitive member therein.

At least one of the carrying portions may have a different protruding length than the remaining carrying portions protruding toward the image carrier.

The carrying portion of the developing unit, disposed at the farthest upstream side with respect to the rotating direction of the photosensitive member, may protrude the farthest toward the photosensitive member.

The developing units respectively may include developing members to attach the developer to the photosensitive member, and the carrying portions respectively may include developer shields provided along a longitudinal direction of the developing members, each developer shield having one side fixed to the corresponding carrying portion and an other side adjacent to the corresponding developing member.

At least one of the first, second and third developing units may be provided to supply the developer to the photosensitive member by a feeding angle that is an acute angle relative to a horizontal plane.

The feeding angle may be less than half of an angle of repose of the developer.

The feeding angle may be substantially 10 degrees.

The foregoing and/or other aspects and utilities of the general inventive concept may also be achieved by providing an image forming apparatus including plural developing units respectively including photosensitive members and adapted to supply developers to the respective photosensitive members, a light scanning device to scan light to the respective photosensitive members so as to form electrostatic latent images, and an intermediate transfer member to hold images transferred from the photosensitive members, wherein the plural developing units include a first developing unit including a developer storage portion having a first volume, a second developing unit including a developer storage portion having a second volume less than the first volume, and at least one third developing unit including a developer storage portion having a third volume less than the second volume, and the second developing unit is disposed at the farthest downstream side with respect to a rotating direction of the intermediate transfer member.

The first developing unit, the second developing unit and the at least one third developing unit may be arranged parallel and adjacent to one another along the rotating direction of the intermediate transfer member.

The image forming apparatus may further include a cleaning unit to remove residual developer on the intermediate transfer member by coming into frictional contact with the intermediate transfer member, the light scanning device may form an electrostatic latent image for lubrication on the photosensitive member of the second developing unit, and the second developing unit may supply the developer to the electrostatic latent image for lubrication to form a developer image for lubrication, thereby reducing friction between the intermediate transfer member and the cleaning unit.

The foregoing and/or other aspects and utilities of the general inventive concept may also be achieved by providing a developing device of an image forming apparatus to supply developer to a rotating image carrier including plural developing units arranged parallel and adjacent to one another along a rotating direction of the image carrier, wherein the plural developing units include a first developing unit having a largest developer storage capacity, and a second developing unit disposed at the farthest downstream side with respect to the rotating direction of the image carrier, the second developing unit having a developer storage capacity smaller than the developer storage capacity of the first developing unit and larger than a developer storage capacity of the remaining developing units.

The foregoing and/or other aspects and utilities of the general inventive concept may also be achieved by providing an image forming apparatus including plural developing units arranged parallel and adjacent to one another along a rotating direction of an image carrier, at least one of the developing units having a different developer storage capacity from the developer storage capacity of the remaining developing units, and carrying portions provided at the respective developing units, to receive residual developer not attached to the image carrier, wherein the farthest upstream carrying portion, formed at one of the developing units disposed at the farthest upstream side with respect to the rotating direction of the image carrier, protrudes the farthest toward the image carrier than the carrying portions formed at the remaining developing units.

The foregoing and/or other aspects and utilities of the general inventive concept may also be achieved by providing an image forming apparatus including plural developing units arranged parallel and adjacent to one another along a rotating direction of an image carrier and respectively including developing members to attach developers to the image carrier, at least one of the developing units having a different developer storage capacity, and carrying portions integrally formed with the developing units at positions underneath the developing members, to receive residual developers not attached to the image carrier therein.

At least one of the carrying portions formed at the respective developing units may have a different protruding length than the remaining carrying portions protruding toward the image carrier.

The carrying portion of the developing unit, disposed at the farthest upstream side with respect to the rotating direction of the image carrier, may protrude the farthest toward the image carrier.

The image forming apparatus may further include developer shields provided along a longitudinal direction of the developing members and tilted toward a rotating direction of the developing members, each developer shield having one side fixed to the corresponding carrying portion and the other side adjacent to the corresponding developing member.

The foregoing and/or other aspects and utilities of the general inventive concept may also be achieved by providing a developing unit usable with an image forming apparatus, the developing unit including a developer storage capacity smaller than a developer storage capacity of a first developing unit provided to supply black developer to an image carrier and larger than a developer storage capacity of a second developing unit provided to supply second-color developer to the image carrier, wherein the developing unit is disposed at the farthest downstream side of first and second developing units arranged parallel and adjacent to one another along a rotating direction of an image carrier, and is provided to supply first-color developer to the image carrier.

The foregoing and/or other aspects and utilities of the general inventive concept may also be achieved by providing a developing unit to store black developer usable with an image forming apparatus including first and second developing units arranged parallel and adjacent to one another other along a rotating direction of an image carrier, the developing unit including a developer storage capacity larger than a developer storage capacity of the first developing unit, the developer storage capacity of the developing unit is larger than a developer storage capacity of the second developing unit disposed at the farthest downstream side with respect to the rotating direction of the image carrier, wherein the developing unit is disposed upstream of the first developing unit provided to supply first-color developer to the image carrier.

The foregoing and/or other aspects and utilities of the general inventive concept may also be achieved by providing a developing unit usable with an image forming apparatus having first and second developing units arranged parallel and adjacent to one another other along a rotating direction of an image carrier, the developing unit including a developer storage capacity smaller than a developer storage capacity of the first developing unit provided to supply black developer to the image carrier, wherein the developer storage capacity of the developing unit is smaller than a developer storage capacity of a second developing unit disposed at the farthest downstream side with respect to the rotating direction of the image carrier, and the developing unit is disposed between the first developing unit and the second developing unit in the rotating direction of the image carrier.

The developing unit may be configured to supply the developer to the image carrier by a feeding angle that is an acute angle less than half of an angle of repose of the developer relative to a horizontal plane.

The feeding angle may be substantially 10 degrees.

The foregoing and/or other aspects and utilities of the general inventive concept may also be achieved by providing a developing unit usable with an image forming apparatus including a developing unit housing, a developer storage portion provided in the developing unit housing, a developing member to attach developer received in the developer storage portion to an image carrier, and a carrying portion provided underneath the developing member and extending to the front side of the developing unit housing so as not to interfere with the image carrier, the carrying portion receiving residual developer not attached to the image carrier by the developing member.

The foregoing and/or other aspects and utilities of the general inventive concept may also be achieved by providing a developing unit usable with an image forming apparatus including a developing unit housing, a developer storage portion provided in the developing unit housing, a developing member to attach developer received in the developer storage portion to an image carrier, a carrying portion provided underneath the developing member and extending to the front side of the developing unit housing so as not to interfere with the image carrier, the carrying portion receiving residual developer not attached to the image carrier by the developing member, and a developer shield provided along a longitudinal direction of the developing member and having one side fixed to the carrying portion and an other side adjacent to the developing member.

The foregoing and/or other aspects and utilities of the general inventive concept may also be achieved by providing an image forming apparatus including plural developing units arranged parallel and adjacent to one another other along a rotating direction of an image carrier, at least one of the developing units having a different developer storage capacity, wherein each developing unit is provided to supply the developer to the image carrier by a feeding angle that is an acute angle less than half of an angle of repose of the developer relative to a horizontal plane.

The feeding angle may be substantially 10 degrees.

The foregoing and/or other aspects and utilities of the general inventive concept may also be achieved by providing an image forming apparatus including an image carrier having a rotating direction and a plurality of developing units having developer storage capacities and carrying portions to receive residual developer, wherein one of the plurality of developing units disposed at the farthest upstream side with respect to the rotating direction of the image carrier has a respective developer storage capacity more than at least one of the remaining developing units, and a respective carrying portion that protrudes toward the image carrier more than other carrying portions of the remaining developing units.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
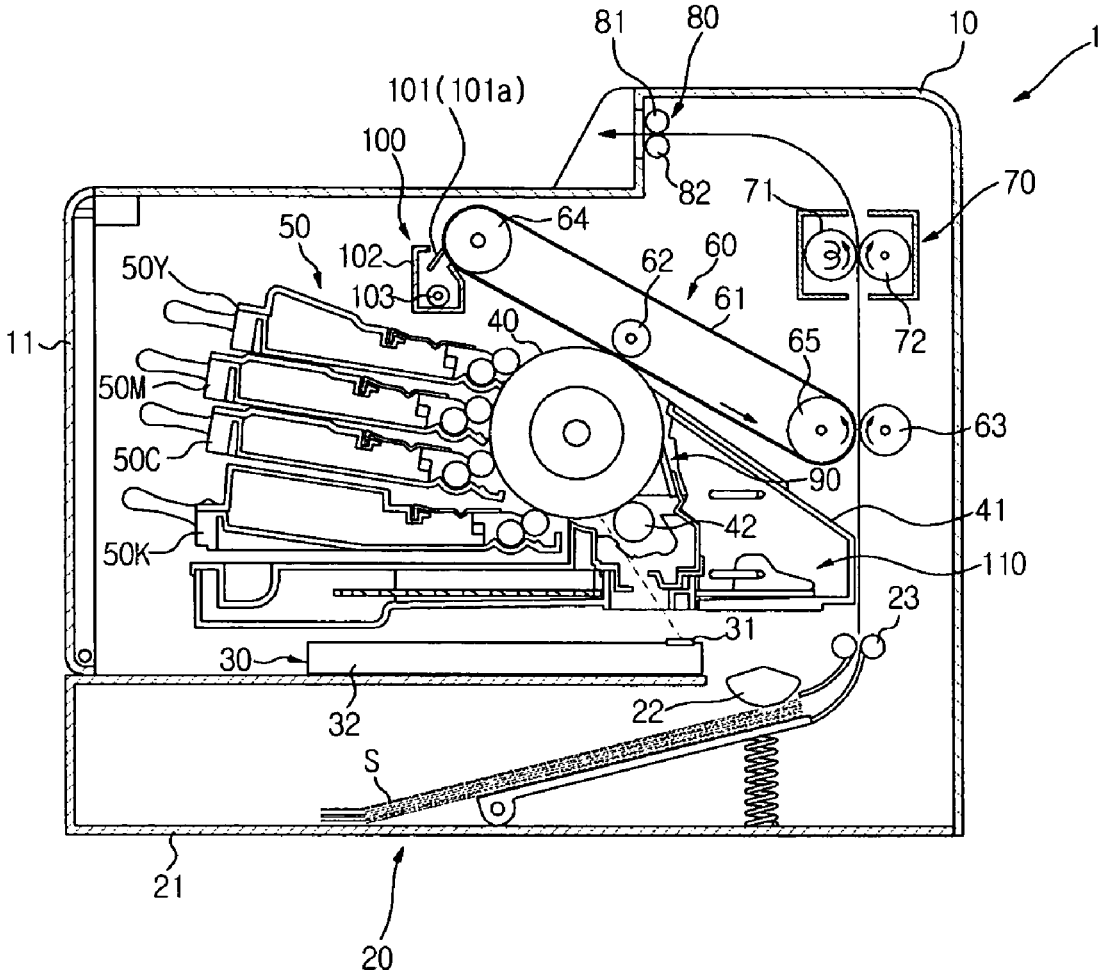
FIG. 1 is a view illustrating a configuration of an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
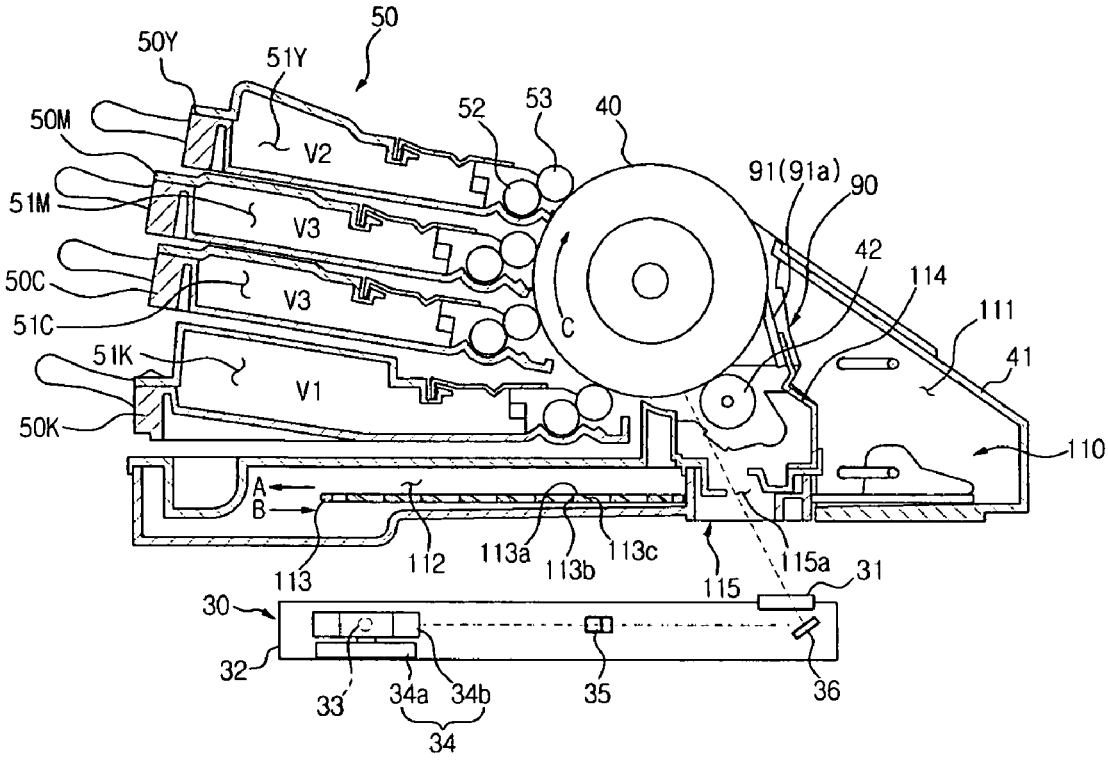
FIG. 2 is a view of a portion of the image forming apparatus illustrated in FIG. 1.

FIG. 1 is a view illustrating a configuration of an image forming apparatus in accordance with an embodiment of the present general inventive concept. FIG. 2 is a view of a portion of the image forming apparatus illustrated in FIG. 1.

As illustrated in FIGS. 1 and 2, the image forming apparatus 1 includes a body 10, a printing medium feeding device 20, a light scanning device 30, a photosensitive member 40, a developing device 50, a transfer device 60, a fixing device 70, and a printing medium discharge device 80.

The body 10 defines an external appearance of the image forming apparatus 1, and supports a variety of elements installed therein. A body cover 11 is pivotally rotatably coupled to one side of the body 10, to open or close a portion of the body 10. A user can access an interior of the body 10 through the body cover 11, to attach or detach a variety of elements including the developing device 50.

The printing medium feeding device 20 includes a cassette 21 in which a printing medium S is loaded, a pickup roller 22 to pick up the printing medium S loaded in the cassette 21 sheet by sheet, and a transportation roller 23 to transport the picked-up printing medium S to the transfer device 60.

The light scanning device 30 serves to form an electrostatic latent image on the photosensitive member 40 by scanning light to the photosensitive member 40. While the image forming apparatus 1 carries out a printing operation, the light scanning device 30 scans light, which corresponds to image information, to the photosensitive member 40. Also, while the image forming apparatus 1 carries out a lubricating operation for the photosensitive member 40 and the transfer device 60, the light scanning device 30 forms an electrostatic latent image for lubrication on the photosensitive member 40. The electrostatic latent image for lubrication may have a band shape along an axial direction of the photosensitive member 40.

The light scanning device 30 includes a case 32 provided with a light-transmission member 31 to allow emission of light to the outside, and a scanning optical system mounted in the case 32.

The scanning optical system includes a light source 33 to emit light, a light deflector 34 to deflect the light emitted from the light source 33, an F-theta lens 35 to compensate for an aberration of the light deflected by the light deflector 34, and a reflecting mirror 36 to reflect the light, having passed through the F-theta lens 35, toward the photosensitive member 40.

The light deflector 34 includes a drive motor 34*a*, and a polygonal mirror 34*b* to be rotated by the drive motor 34*a*. The polygonal mirror 34*b* has a plurality of reflective faces at respective sides thereof, and serves to deflect the light from the light source 33.

Specifically, the light emitted from the light source 33 is deflected by the rotating polygonal mirror 34*b*, and, after passing through the F-theta lens 35, is reflected toward the light-transmission member 31 by the reflecting mirror 36. The light reflected by the reflecting mirror 36 is emitted to the outside of the case 32 through the light-transmission member 31, to thereby be scanned to the photosensitive member 40 so as to form an electrostatic latent image on a surface of the photosensitive member 40. The light-transmission member 31 may be made of transparent glass or plastic, or the like. Alternatively, a slit-shaped light-transmittable space may substitute for the light-transmission member 31.

The photosensitive member 40 is an image carrier to hold an electrostatic latent image formed by the light scanning device 30 and a developer image formed by the developing device 50. Although the present embodiment illustrates a cylindrical drum-type photosensitive member, a rotatable endless belt-type photosensitive member may also be used.

In the present embodiment, the photosensitive member 40 is rotatably mounted to a photosensitive member housing 41, which is in turn detachably mounted in the body 10. The photosensitive member 40 may be permanently fixed to the body 10 so as not to be separated from the body 10. A charging member 42 is mounted in the photosensitive member housing 41. The charging member 42 charges the photosensitive member 40 with a predetermined electric potential before the light scanning device 30 scans light to the photosensitive member 40. The charging member 42 can be selected, according to an operating method thereof, from among a cylindrical roller type, a corona type using a conductive linear material, and a conductive plate type.

The developing device 50 is adapted to form a visible developer image by supplying developer to the photosensitive member on which the electrostatic latent image is formed. The developing device 50 may be composed of four developing units 50K, 50C, 50M and 50Y to receive different colors of developers, for example, Black, Cyan, Magenta, and Yellow, respectively. Hereinafter, when it is necessary to differentiate the four developing units 50K, 50C, 50M and 50Y, they are called, respectively, black developing unit 50K, cyan developing unit 50C, magenta developing unit 50M, and yellow developing unit 50Y.

The developing units 50K, 50C, 50M and 50Y can be arranged parallel and adjacent to one another along a rotating direction ("C" direction) of the photosensitive member 40. Although FIG. 2 illustrates an example wherein the black developing unit 50K, cyan developing unit 50C, magenta developing unit 50M, and yellow developing unit 50Y are arranged in this order along the rotating direction of the photosensitive member 40, the respective developing units are not essentially arranged like this, and the arrangement order of the developing units 50K, 50C, 50M and 50Y can be changed if necessary.

Each of the developing units 50K, 50C, 50M and 50Y includes a developer storage portion 51K, 51C, 51M or 51Y, a feeding member 52, and a developing member 53. For convenience of illustration, in FIG. 2, only the feeding member and the developing member of the developing unit 50Y are designated by reference numerals 52 and 53.

The developer storage portion 51K, 51C, 51M or 51Y stores developer to be supplied to the photosensitive member 40, and the feeding member 52 supplies the developer stored in the developer storage portion 51K, 51C, 51M or 51Y to the developing member 53. The feeding member 52 may take a form of a roller or plate according to the configuration of the developing unit 50K, 50C, 50M or 50Y. Of course, omitting the feeding member 52 is allowable. The developing member 53 attaches the developer to the surface of the photosensitive member 40 on which an electrostatic latent image is formed, to form a visible image. The developing member 53 may be made of a rubber or metal cylinder as proposed in the present embodiment, or may take the form of a belt, tube, or the like.

Basically, the developing units 50K, 50C, 50M and 50Y supply developers to the photosensitive member 40 while the image forming apparatus 1 prints an image on a printing medium, so as to form developer images. However, one of the developing units 50K, 50C, 50M and 50Y, i.e. the farthest downstream developing unit with respect to the rotating direction of the photosensitive member 40 can be used to supply the developer to the photosensitive member 40 even while the image forming apparatus 1 carries out a lubricating operation, thereby forming a developer image for lubrication.

By using the farthest downstream developing unit with respect to the rotating direction of the photosensitive member 40 to form the developer image for lubrication, a printing operation can be initiated by operating the developing units 50K, 50C, 50M and 50Y immediately after forming the developer image for lubrication on the photosensitive member 40. This has the effect of preventing degradation of printing speed in a successive printing operation. Furthermore, preventing the developer image for lubrication formed on the photosensitive member 40 from contaminating the developing members 53 by passing through the developing units 50K, 50C, 50M and 50Y is possible.

Of the developing units 50K, 50C, 50M and 50Y, the black developing unit 50K may be provided with the largest storage capacity. Also, the farthest downstream developing unit with respect to the rotating direction of the photosensitive member 40, i.e. the yellow developing unit 50Y may be provided to have the second largest storage capacity after the black developing unit 50K.

Specifically, the developer storage portion 51K of the black developing unit 50K may be configured to have a first volume V1, and the developer storage portion 51Y of the yellow developing unit 50Y disposed at the farthest downstream side with respect to the rotating direction of the photosensitive member 40 may be configured to have a second volume V2 less than the first volume V1. Also, the developer storage portions 51C and 51M of other developing units 50C and 50M may be configured to have a third volume V3 less than the second volume V2.

The black developing unit 50K has the largest developer storage capacity because only black developer is used in black-and-white printing, and therefore black developer is used most frequently.

Also, the yellow developing unit 50Y disposed at the farthest downstream side with respect to the rotating direction of the photosensitive member 40 is configured to have the second largest developer storage capacity such that the yellow developing unit 50Y can store a greater amount of developer than the other developing units 50C and 50M in consideration of an amount of the developer to be consumed during a lubricating operation of the image forming apparatus.

Although the present embodiment exemplifies that the yellow developing unit 50Y is disposed at the farthest downstream side with respect to the rotating direction of the photosensitive member 40, the yellow developing unit 50Y may be substituted by the magenta developing unit 50M or the cyan developing unit 50C as an occasion demands.

The transfer device 60 includes an intermediate transfer belt 61, a first transfer roller 62, and a second transfer roller 63.

The intermediate transfer belt 61 is supported by supporting rollers 64 and 65 and is adapted to travel at a same speed as a linear velocity of the photosensitive member 40. The first transfer roller 62 is opposite the photosensitive member 40 with the intermediate transfer belt 61 interposed therebetween, to transfer a developer image formed on the photosensitive member 40 to the intermediate transfer belt 61.

The second transfer roller 63 is opposite the supporting roller 65 with the intermediate transfer belt 61 interposed therebetween. The second transfer roller 63 is spaced apart from the intermediate transfer belt 61 while the image is transferred from the photosensitive member 40 to the intermediate transfer belt 61, and then, comes into contact with the intermediate transfer belt 61 at a desired pressure after the image on the photosensitive member 40 is completely transferred to the intermediate transfer belt 61. The image on the intermediate transfer belt 61 is transferred to a printing medium when the second transfer roller 63 comes into contact with the intermediate transfer belt 61.

The second transfer roller 63 is spaced apart from the intermediate transfer belt 61 while the image forming apparatus 1 carries out the lubricating operation. Accordingly, the lubricating developer image transferred from the photosensitive member 40 to the intermediate transfer belt 1 passes over the second transfer roller 63, and is removed by a cleaning device that will be described hereinafter.

As illustrated in FIGS. 1 and 2, the image forming apparatus 1 includes a first cleaning device 90 to remove residual developer on the photosensitive member 40, a second cleaning device 100 to remove residual developer from the intermediate transfer belt 61, and a waste developer reservoir 110 to store waste developer collected from the photosensitive member 40.

The first cleaning device 90 includes a cleaning unit 91 arranged to come into contact with the photosensitive member 40. The cleaning unit 91 generates friction with the photosensitive member 40, to scrape residual developer from the surface of the photosensitive member 40. The cleaning unit 91 may take a form of a cleaning blade 91*a*, which is mounted inside the photosensitive member housing 41 and comes into contact, at one end thereof, with the photosensitive member 40.

The second cleaning device 100 includes a cleaning unit 101 arranged to come into contact with the intermediate transfer belt 61, a waste developer collecting case 102 to temporarily store waste developer collected from the intermediate transfer belt 61 by the cleaning unit 101, and a transportation unit 103 to transport the waste developer collected in the waste developer collecting case 102.

The cleaning unit 101 may take the form of a cleaning blade 101*a* having one end serving to generate friction with the intermediate transfer belt 61 so as to scrape residual developer from the surface of the intermediate transfer belt 61. The transportation unit 103 may take the form of an auger having a spiral blade to transport the waste developer via rotation thereof.

Although FIGS. 1 and 2 illustrate an example wherein the cleaning blades 91*a* and 101*a* are used as the cleaning units 91 and 101, of course, brush-type or roller-type elements may be used as the cleaning units.

The waste developer reservoir 110 includes a first waste developer storage portion 111, a second waste developer storage portion 112, and a waste developer transportation member 113.

The first waste developer storage portion 111 and the second waste developer storage portion 112 are defined in the photosensitive member housing 41. A supporting member 114 is installed at one side of the first waste developer storage portion 111, and the cleaning blade 91*a* is fixed to an end of the supporting member 114. The waste developer, removed from the photosensitive member 40 by the cleaning blade 91*a*, is first stored in the first waste developer storage portion 111, and is transported into the second waste developer storage portion 112 by the waste developer transportation member 113.

A light window 115 is provided between the first waste developer storage portion 111 and the second waste developer storage portion 112. The light window 115 has a light-transmission opening 115*a* perforated through the photosensitive member housing 41, to allow the light emitted from the light scanning device 30 to reach the photosensitive member 40 by passing through the photosensitive member housing 41.

Also, a developer movement passage (not illustrated) is provided between the first waste developer storage portion 111 and the second waste developer storage portion 112. The developer movement passage (not illustrated) provides a detour to move the developer, stored in the first waste developer storage portion 111, toward the second waste developer storage portion 112, at both sides of the light window 115.

The waste developer transportation member 113 is installed in the photosensitive member housing 41, to enable linear movement thereof. The waste developer transportation member 113, as illustrated in FIG. 2, carries out reciprocating movements in "A" and "B" directions, to transport the waste developer stored in the first and second waste developer storage portions 111 and 112 in the "A" direction.

The waste developer transportation member 113 includes transportation ribs 113*a* spaced apart from one another. One side surface 113*b* of each transportation rib 113*a* facing the waste developer transportation direction, i.e. the "A" direction is formed into a vertical surface suitable to effectively transport the developer. Alternatively, an other side surface 113*c* of the transportation rib 113*a* opposite to the side surface 113*b* can be formed into an inclined surface, to substantially prevent backflow of the waste developer when the transportation rib 113 moves in an opposite direction of the waste developer transportation direction.

Meanwhile, as illustrated in FIG. 1, the fixing device 70 includes a heating roller 71 having a heating source, and a pressure roller 72 installed opposite the heating roller 71. When a printing medium passes through a gap between the heating roller 71 and the pressure roller 72, an image is fixed to the printing medium by heat transmitted from the heating roller 71 and pressure exerted between the heating roller 71 and the pressure roller 72.

The printing medium discharge device 80 includes a printing medium discharge roller 81, and a printing medium backup roller 82, to discharge the printing medium, having passed through the fixing device 70, to the outside of the body 10.

Figure 3:
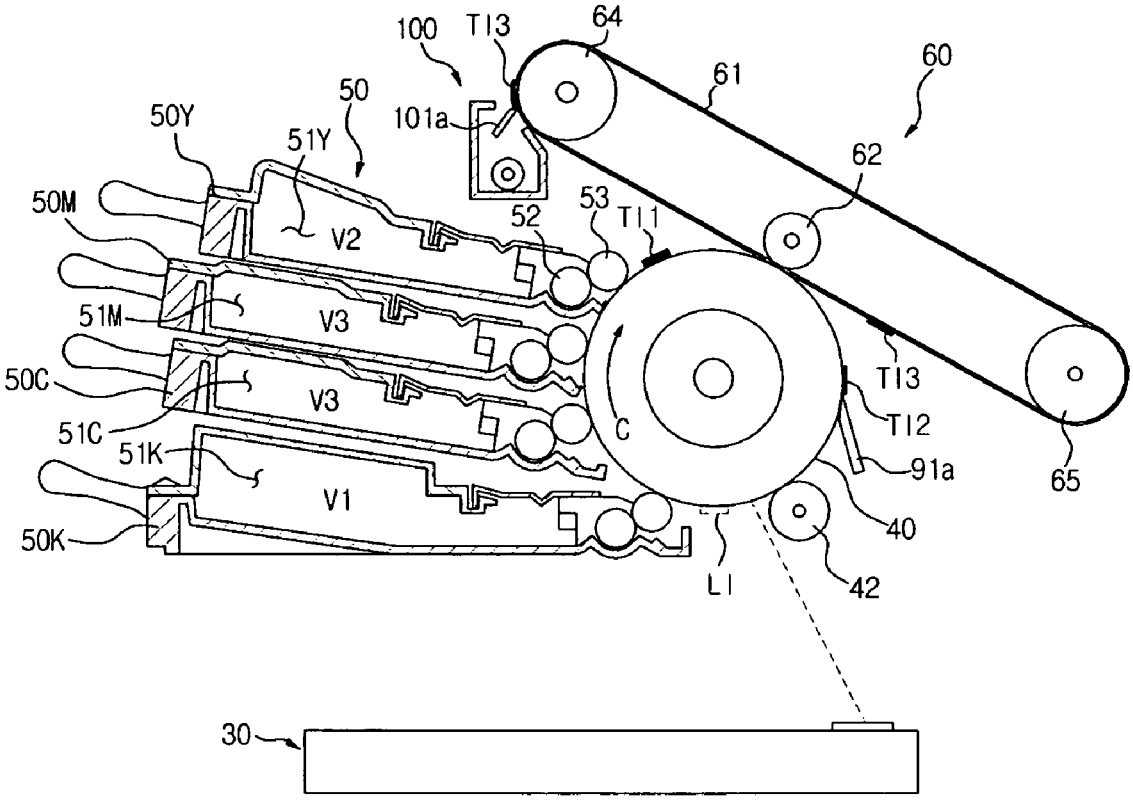
FIG. 3 is a view illustrating an operation of the image forming apparatus illustrated in FIG. 1.

An operation of the image forming apparatus having the above-described configuration will be described with reference to FIGS. 1 to 3. FIG. 3 is an explanatory view of an operation of the image forming apparatus illustrated in FIG. 1.

If a printing operation begins, the charging member 42 uniformly charges the surface of the photosensitive member 40. Then, the light scanning device 30 scans light, which corresponds to image information of any one color, for example, yellow, to the uniformly charged surface of the photosensitive member 40, forming an electrostatic latent image corresponding to the yellow image information on the photosensitive member 40.

Subsequently, a developing bias is applied to the developing member 53 of the yellow developing unit 50Y, to attach yellow developer to the electrostatic latent image. Thereby, a yellow developer image can be formed on the photosensitive member 40. The developer image is transferred to the intermediate transfer belt 61 by the first transfer roller 62.

After the transfer of the yellow image for a page is completed, the light scanning device 30 scans light corresponding to image information of another color, for example, magenta to the photosensitive member 40, forming an electrostatic latent image corresponding to the magenta image information on the photosensitive member 40. The magenta developing unit 50M supplies magenta developer to the electrostatic latent image to form a developer image. The magenta developer image formed on the photosensitive member 40 is transferred to the intermediate transfer belt 61 by the first transfer roller 62. In this case, the magenta developer image overlaps the previously transferred yellow developer image.

By performing the above-described operation for cyan and black developers, a color image can be formed on the intermediate transfer belt 61 by overlapping the yellow, magenta, cyan and black images. The resulting color image is transferred to the printing medium which is passing through the gap between the intermediate transfer belt 61 and the second transfer roller 63. Then, the printing medium is discharged to the outside of the body 10 by way of the fixing device 70 and the printing medium discharge device 80.

In the above-described printing operation, when the developer image is transferred to the intermediate transfer belt 61 or the printing medium, a portion of the developer remains on the photosensitive member 40 or the intermediate transfer belt 61. The resulting waste developer is removed by the cleaning blades 91*a* and 101*a* which come into frictional contact with the photosensitive member 40 and the intermediate transfer belt 61.

When carrying out a successive printing operation using a special printing medium such as an envelope or label, which has a smaller width than generally used printing media (for example, A4-size-paper), or using a printing medium having a high transfer efficiency (for example, OHP film), there may occur damage to the intermediate transfer belt 61 or the cleaning blades 91*a* and 101*a* may be overturned because of friction between the printing medium and the cleaning blades 91*a* and 101*a*. In this case, the image forming apparatus 1 carries out a lubricating operation to form a developer image for lubrication on the image carrier after printing a page prior to printing a subsequent page.

Referring to FIG. 3, in the lubricating operation of the image forming apparatus 1 (FIG. 1), the light scanning device 30 scans light to the photosensitive member to form a band-shaped electrostatic latent image L1 for lubrication along an axial direction of the photosensitive member 40.

Of the developing units 50K, 50C, 50M and 50Y, the yellow developing unit 50Y, which is disposed at the farthest downstream side with respect to the rotating direction ("C" direction) of the photosensitive member 40, supplies developer to the electrostatic latent image for lubrication, so as to form a developer image for lubrication TI1.

The developer image for lubrication formed on the surface of the photosensitive member 40 reaches the intermediate transfer belt 61 via rotation of the photosensitive member 40. In this case, a portion of the developer image for lubrication is transferred to the intermediate transfer belt 61 by the first transfer roller 62, and the remaining portion remains on the photosensitive member 40.

The developer image for lubrication TI2 remaining on the photosensitive member 40 is removed by the cleaning blade 91*a* via rotation of the photosensitive member 40. In this case, the developer image for lubrication serves as a lubricant between the photosensitive member 40 and the cleaning blade 91*a*.

Meanwhile, the developer image for lubrication TI3 transferred to the intermediate transfer belt 61 is removed by the cleaning blade 101*a* via rotation of the intermediate transfer belt 61, and serves as a lubricant between the intermediate transfer belt 61 and the cleaning blade 101*a*.

Figure 4:
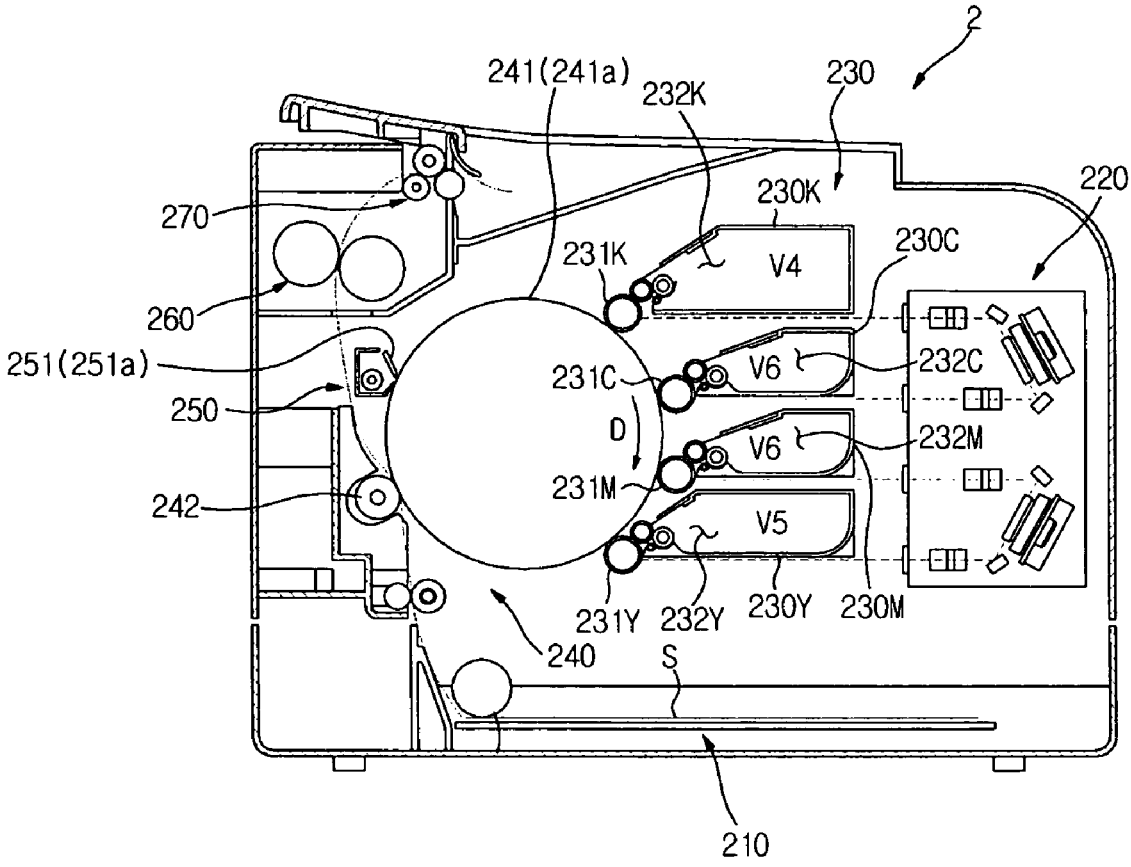
FIG. 4 is a view illustrating a configuration of an image forming apparatus in accordance with another embodiment of the present general inventive concept.

FIG. 4 is a view illustrating a configuration of an image forming apparatus in accordance with another embodiment of the present general inventive concept. The present embodiment exemplifies the use of a plurality of photosensitive members.

As illustrated in FIG. 4, the image forming apparatus 2 includes a printing medium feeding device 210, a light scanning device 220, a developing device 230, a transfer device 240, a cleaning device 250, a fixing device 260, and a printing medium discharge device 270.

The printing medium feeding device 210 supplies a printing medium S toward the transfer device 240, and the light scanning device 220 scans light to photosensitive members 231K, 231C, 231M, and 231Y, to form electrostatic latent images, respectively.

The developing device 230 forms a visible image by supplying developer to the electrostatic latent images formed on the respective photosensitive members 231K, 231C, 231M and 231Y. The developing device 230 may be composed of four developing units 230K, 230C, 230M and 230Y to receive different colors of developers, for example, Black, Cyan, Magenta, and Yellow, respectively.

The developing units 230K, 230C, 230M and 230Y are provided with the photosensitive members 231K, 231C, 231M and 231Y, respectively. Also, each of the developing units 230K, 230C, 230M and 230Y includes a developer storage portion 232K, 232C, 232M or 232Y in which developer to be supplied to the corresponding photosensitive member is stored, a feeding member 233, and a developing member 234.

The transfer device 240 includes an intermediate transfer member 241 and a transfer roller 242. The intermediate transfer member 241 is an image carrier to hold a developer image formed by the developing device 230.

During a printing operation of the image forming apparatus, developer images formed on the photosensitive members 231K, 231C, 231M and 231Y are transferred to the intermediate transfer member 241 to thereby overlap on the intermediate transfer member 241. The resulting overlapped color image is transferred to a printing medium which is passing through a gap between the transfer roller 242 and the intermediate transfer member 241.

The intermediate transfer member 241 may be a transfer drum 241*a*, which is rotated in contact with the photosensitive members 231K, 231C, 231M and 231Y. Although FIG. 4 illustrates the intermediate transfer member in the form of the transfer drum 241*a*, of course, a belt-type intermediate transfer member is also applicable.

The cleaning device 250 includes a cleaning unit 251, which generates friction with the intermediate transfer member 241, to scrape waste developer remaining on the intermediate transfer member 241. The cleaning unit 251 may take the form of a cleaning blade 251*a*, which comes into frictional contact, at one end thereof, with a surface of the intermediate transfer member 241.

The developing units 230K, 230C, 230M and 230Y can be arranged parallel and adjacent to one another along a rotating direction ("D" direction) of the intermediate transfer member 241. Although FIG. 4 illustrates an example wherein the black developing unit 230K, cyan developing unit 230C, magenta developing unit 230M, and yellow developing unit 230Y are arranged in this order along the rotating direction of the intermediate transfer member 241, the respective developing units are not essentially arranged like this, and the arrangement order of the developing units 230K, 230C, 230M and 230Y can be changed if necessary.

The developing units 230K, 230C, 230M and 230Y supply the developers to the intermediate transfer member 241 to form developer images while the image forming apparatus 2 carries out a printing operation. However, one of the developing units 230K, 230C, 230M and 230Y, which is disposed at the farthest downstream side with respect to the rotating direction of the intermediate transfer member 241, can also be used to supply the developer to the intermediate transfer member 241 even while the image forming apparatus 2 carries out a lubricating operation, thereby forming a developer image for lubrication.

During the lubricating operation of the image forming apparatus 2, the light scanning device 220 forms a band-shaped electrostatic latent image for lubrication on the photosensitive member 231Y provided at the yellow developing unit 230Y which is disposed at the farthest downstream side. Then, the yellow developing unit 230Y supplies developer to the electrostatic latent image for lubrication, so as to form a developer image for lubrication on the photosensitive member 231Y. The developer image for lubrication formed on the photosensitive member 231Y is transferred to the intermediate transfer member 241, and is removed by the cleaning blade 251*a* via rotation of the intermediate transfer member 241. In this case, the developer image for lubrication reduces friction between the intermediate transfer member 241 and the cleaning blade 251*a*.

By using the developing unit disposed at the farthest downstream side with respect to the rotating direction of the intermediate transfer member 241 to form the developer image for lubrication, the printing operation can be initiated by operating the developing units 230K, 230C, 230M and 230Y immediately after forming the developer image for lubrication on the intermediate transfer member 241. This has the effect of preventing degradation of printing speed in a successive printing operation. Furthermore, it is possible to prevent the developer image for lubrication formed on the intermediate transfer member 241 from contaminating the photosensitive members 231K, 231C, 231M and 231Y by passing the developing units 230K, 230C, 230M and 230Y is possible.

Of the developing units 230K, 230C, 230M and 230Y, the black developing unit 230K may be provided to have the largest storage capacity. Also, the developing unit disposed at the farthest downstream side with respect to the rotating direction of the intermediate transfer member 241, i.e. the yellow developing unit 230Y may be provided to have the second largest storage capacity after the black developing unit 230K.

Specifically, the developer storage portion 231K of the black developing unit 230K may be configured to have a first volume V4, and the developer storage portion 231Y of the yellow developing unit 230Y disposed at the farthest downstream side with respect to the rotating direction of the intermediate transfer member 241 may be configured to have a second volume V5 less than the first volume V4. Also, the developer storage portions 232C and 2321M of the other developing units 230C and 230M may be configured to have a third volume V6 less than the second volume V5.

Figure 5:
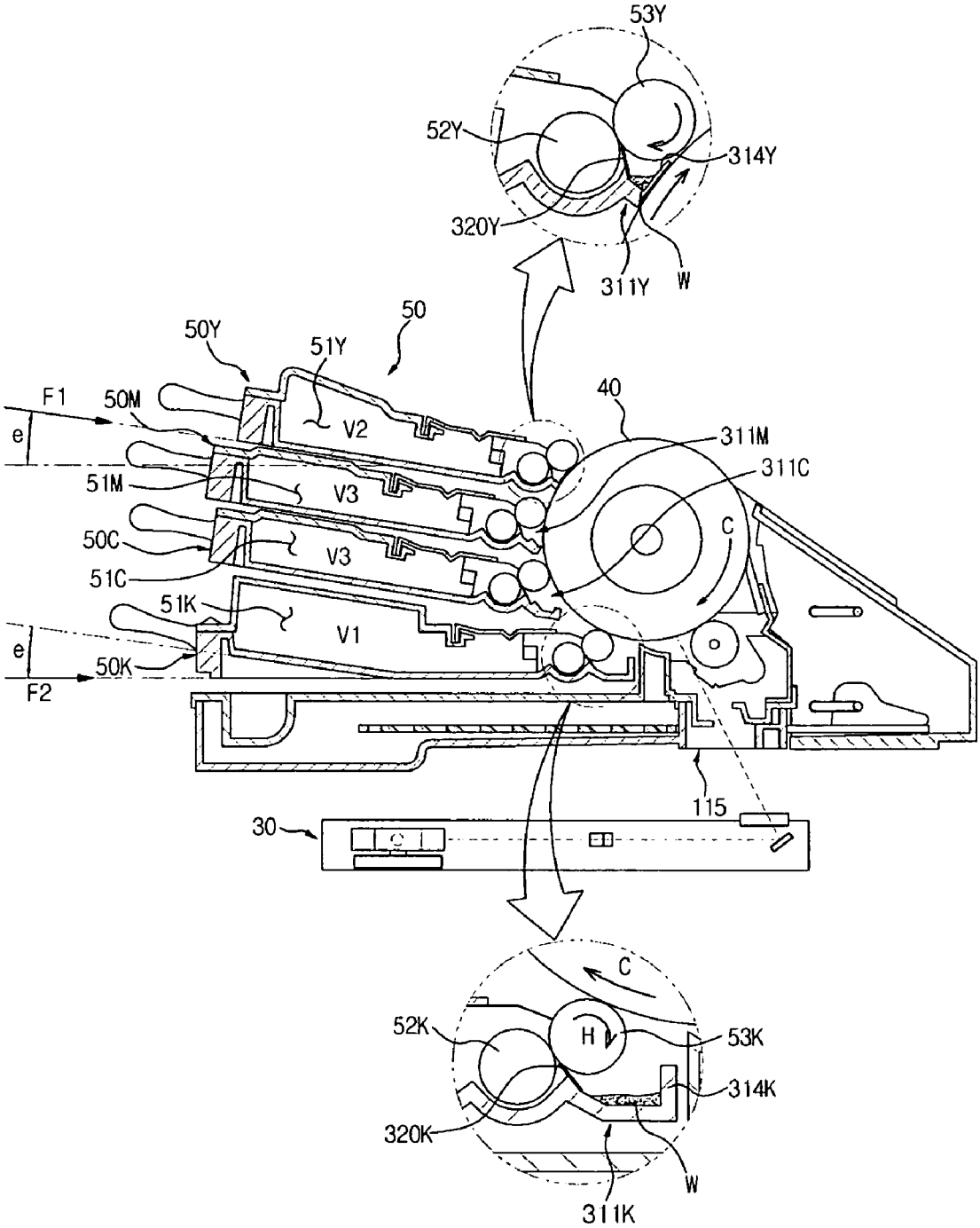
FIG. 5 is a view illustrating a partial configuration of an image forming apparatus in accordance with a further embodiment of the present general inventive concept.
Figure 6:
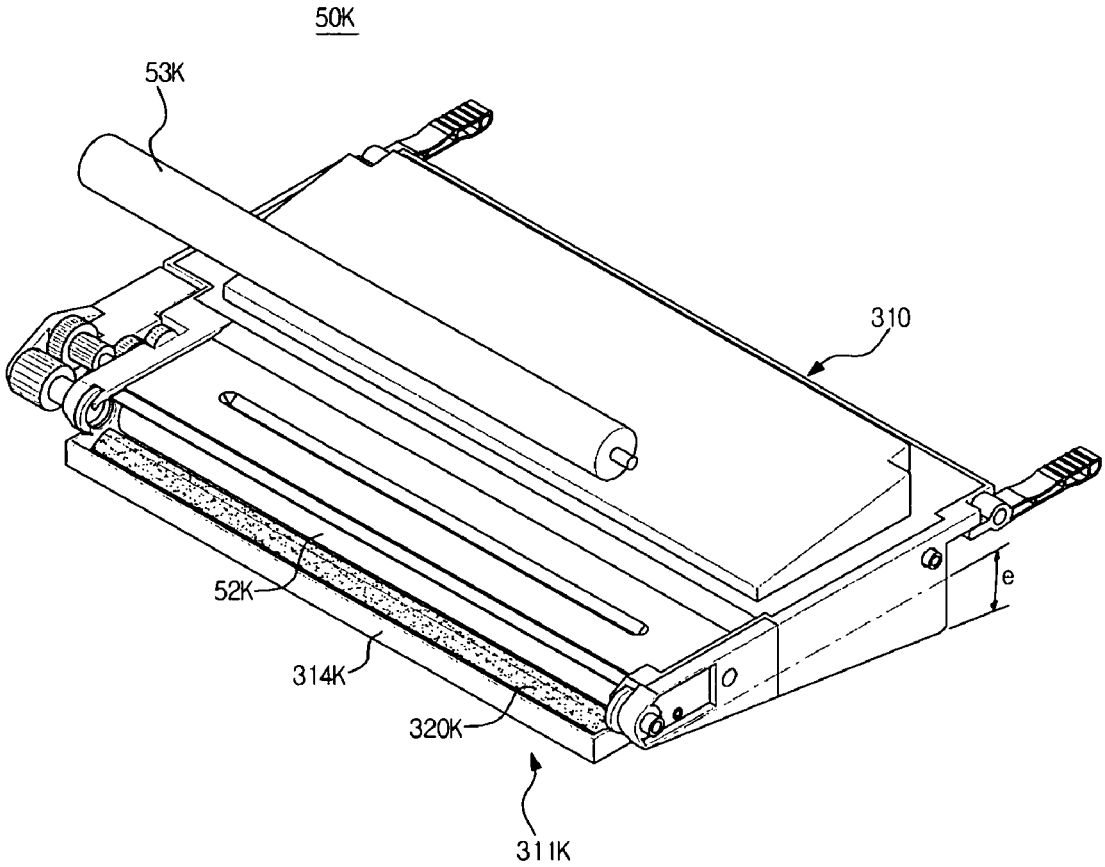
FIG. 6 is a perspective view illustrating a black developing unit of FIG. 5.

FIG. 5 is a view illustrating a partial configuration of an image forming apparatus in accordance with a further embodiment of the present general inventive concept. FIG. 6 is a perspective view illustrating a black developing unit of FIG. 5 according to an embodiment of the present general inventive concept. Hereinafter, only different configurations from the above-described embodiments of the present general inventive concept will be described.

Referring to FIGS. 5 and 6, in the image forming apparatus in accordance with further embodiments of the present general inventive concept, the developing units 50Y, 50M, 50C and 50K, which include the developer storage portions 51Y, 51M, 51C, 51K, are provided with carrying portions 311Y, 311M, 311C and 311K, which protrude toward the photosensitive member 40. The carrying portions 311Y, 311M, 311C and 311K may in turn be provided with developer shields 320Y, 320M, 320C and 320K. In the following description of the carrying portions 311Y, 311M, 311C and 311K and the developer shields 320Y, 320M, 320C and 320K provided at the developing units 50Y, 50M, 50C and 50K, common parts thereof will be described only with respect to the carrying portion 311K and the developer shield 320K provided at the black developing unit 50K. This description will be similarly applied to the carrying portions 311Y, 311M and 311C and the developer shields 320Y, 320M and 320C provided at the other developing units 50Y, 50M and 50C.

The carrying portion 311K is integrally formed with a developing unit housing 310 and is disposed underneath a developing member 53K that is used to attach developer to the photosensitive member 40. The developer stored in the developer storage portion 51K can be moved to the developing member 53K by inclination of the developing unit housing 310. Specifically, the developing unit housing 310 is inclined by a feeding angle (e), to allow the developer to be supplied to the developing member 53K and consequently, to be developed to the photosensitive member 40. In this case, however, a portion of the developer may be scattered.

More specifically, the developing member 53K attaches the developer to a desired portion of the photosensitive member 40, i.e. to the electrostatic latent image, and does not attach the developer to the remaining portion of the photosensitive member 40 not formed with the electrostatic latent image. However, in the course of attaching the developer to the electrostatic latent image, there occurs residual developer (w) not used for image development, and the residual developer is scattered by rotating centrifugal force of the developing member 53K or the photosensitive member 40. In particular, when the developing member 53K is rotated in an opposite direction ("H" direction) of the rotating direction ("C" direction) of the photosensitive member 40 and causes air turbulence, the scattering of developer is increased. Thus, the carrying portion 311K is provided at a downstream side of the developing member 53K with respect to the rotating direction of the developing member 53K, and can effectively receive the residual developer (w) scattered by rotating centrifugal force of the developing member 53K. Accordingly, preventing the residual developer (w) from being scattered within the image forming apparatus, or preventing degradation of printing quality due to the residual developer (w) accumulated at the light window 115 is possible.

The respective developing units 50Y, 50M, 50C and 50K are provided with the carrying portions 311Y, 311M, 311C and 311K, and detailed positions and shapes thereof are different.

More specifically, on a basis of the rotating direction "C" of the photosensitive member 40, the carrying portion 311K of the black developing unit 50K, which is disposed at the farthest upstream side, is provided at a lower end of the photosensitive member 40, and does not encounter interference with the photosensitive member 40. Accordingly, as compared to the carrying portions 311Y, 311M and 311C provided at the other developing units 50Y, 50M, 50C and 50K, the carrying portion 311K can be configured to protrude the farthest toward the photosensitive member 50. With this configuration in which the carrying portion 311K of the black developing unit 50K relatively adjacent to the light window 115 protrudes the farthest toward the photosensitive member 40, the carrying portion 311K can effectively receive the residual developer (w) to attach the residual developer (w) to the photosensitive member 40, and consequently, can prevent the residual developer (w) from being scattered toward the light window 115.

Although the developing members of the other developing units 50Y, 50M and 50C cause the downward scattering of developer, each of the developing units 50Y, 50M and 50C is provided underneath thereof with another developing unit having a sealing function, and therefore, can limit a flow of air and consequently, exhibits relatively low scattering of developer.

For example, the yellow developing unit 50Y causes downward flow of air by the developing member 53, but can limit the flow of air because a predetermined region thereof is blocked by the magenta developing unit 50M disposed underneath thereof. Furthermore, even if the developer is scattered by the developing member 53Y, a predetermined portion of the scattered developer is accumulated on the magenta developing unit 50M, whereby a relatively small amount of developer is scattered to the outside. However, the black developing unit 50K, which is the lowermost developing unit and has no developing unit disposed underneath thereof, encounters relatively intensive flow of air caused by the developing member 53K, as compared to the other developing units. Moreover, as there is no place for accumulation of the black developer scattered by the intensive flow of air underneath the black developing unit 50K and in particular, as the light scanning device 30 used to scan light to the photosensitive member 40 is disposed underneath the black developing unit 50K, there is a problem in that the scattered black developer enters the light scanning device 30 and prevents scanning of light required to form an electrostatic latent image on the photosensitive member 40. For this reason, the carrying portion 311K of the black developing unit 50K must be configured to have the largest developer receiving capacity and the largest protruding length among the other developing units 50Y, 50M and 50C. In addition, the carrying portion 311K has a front surface portion 314K, which is bent to extend toward the photosensitive member 40 disposed thereabove, thereby achieving an increased receiving capacity and preventing air stream from spreading to the light scanning device 30.

Even the yellow developing unit 50Y, magenta developing unit 50M and cyan developing unit 50C are provided with the carrying portions 311Y, 311M and 311C such that the carrying portions 311Y, 311M and 311C can be disposed close to the photosensitive member 40 to the maximum extent within a limit of interfering with the photosensitive member 40 although the respective carrying portions are not disposed as close to the photosensitive medium 40 as the carrying portion 311Y of the yellow developing unit 50Y. By positioning the carrying portions 311Y, 311M and 311C close to the photosensitive member 40 to the maximum extent, the developing units 50Y, 50M and 50C except for the black developing unit 50K, as described above, have an extremely low possibility of scattering of the residual developer (w) not attached to the photosensitive member 40.

Meanwhile, a front surface portion 314Y of the carrying portion 311Y provided at the yellow developing unit 50Y is disclosed close to the photosensitive member 40 to the maximum extent, and is bent upward along a contour of an outer circumferential surface of the photosensitive member 40. Accordingly, the front surface portion 314Y has a minimum spacing distance from the photosensitive member 40. With this arrangement, preventing unused developer, i.e. developer not used for image development or residual developer (w) from being scattered upward of the yellow developing unit 50Y due to an upward air stream caused by rotation of the photosensitive member 40 is possible.

The developer shield 320K is a thin film, which is provided between the developing member 53K and the carrying portion 311K and extends in a longitudinal direction of the developing member 53K. The developer shield 320K is made of a urethane film, PET film, or the like. One side of the developer shield 320K is fixed to the carrying portion 311K, and an other side of the developer shield 320K is provided to be closely adjacent to or come into contact with the developing member 53K or the feeding member 52K. The developer shield 320K serves to shield the developer storage portion 51K from the outside. Specifically, the developer shield 320K blocks the developer stored in the developer storage portion 51K, thereby preventing the developer from leaking to the outside of the black developing unit 50K. The developer shield 320K is obliquely tilted upward and to the left in a rotating direction "H" of the developing member 53K.

The developing units 50Y, 50M, 50C and 50K are provided to supply the developer along a tilted path. An angle of repose related to the feeding angle (e) of the developer will be described with reference to FIG. 7.

Figure 7:
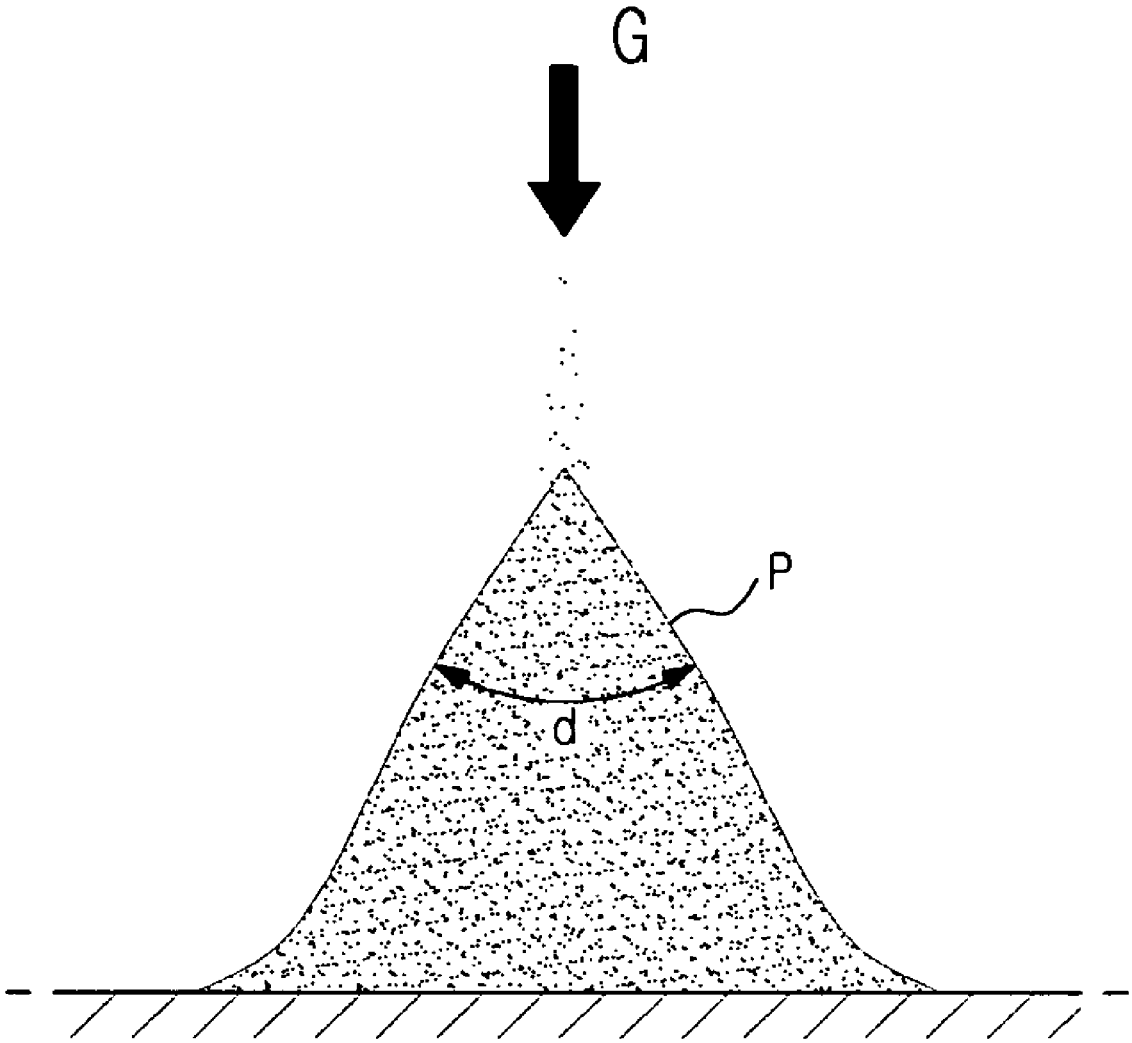
FIG. 7 is a view illustrating an angle of repose of developer according to an embodiment of the present general inventive concept.

As illustrated in FIG. 7, if the developer P falls in a "G" direction, the powder-shaped developer P piles into a cone. Here, an angle defined by an apex of the cone is an angle of repose (d).

If the angle of repose (d) is large, the developer P has a high fluidity. The developer P having the high fluidity is efficient to achieve excellent supply efficiency of developer, but is liable to leak and causes fogging. Here, the term "fogging" refers to a phenomenon in that the developer slightly spreads to a non-image portion. Alternatively, if the angle of repose (d) is small, the developer P has a low fluidity, and the developer P has advantages and disadvantages opposite to the case of the large angle of repose (d). The fluidity of the developer P is determined by the type, size or content of internal or external additives thereof, and in particular, often greatly depends on the type, size or content of silica as one of the external additives.

The developer P must have an appropriate angle of repose (d) due to the close relationship between fluidity of the developer P and the angle of repose (d). The angle of repose (d) of the developer is in a range of 35 to 48 degrees, such as, in a range of 38 to 42 degrees. Meanwhile, an actual feeding angle of developer P from an interior of the developing unit 50K (FIG. 6) is about 20 degrees, that is, for example, half of a respective angle of repose (d).

Hereinafter, a tilted configuration of the developing units 50Y, 50M, 50C and 50K will be described with reference to FIGS. 5 and 6.

When the installation angle of the developing units 50Y, 50M, 50C and 50K is more than 20 degrees, excellent supply efficiency of developer is achieved, but sealing or fogging problems may be encountered. Alternatively, when the installation angle of the developing units 50Y, 50M, 50C and 50K, i.e. the feeding angle of developer, is zero degrees, poor developer supply is achieved, deteriorating image print quality. Therefore, determining an appropriate feeding angle of developer, i.e. an appropriate installation angle of the developing units 50Y, 50M, 50C and 50K improves the general performance of the image forming apparatus.

The installation angle (e) of the developing units 50Y, 50M, 50C and 50K is greater than zero degree, and can be half of the angle of repose of the developer. Specifically, on a basis of a respective angle of repose in a range of 38 to 42 degrees, the installation angle (e) can be in the range of zero to 20 degrees. In the present embodiment, in consideration of supply and sealing efficiency, the installation angle (e) is set to 10 degrees, half of 20 degrees.

In the case of the developing units 50Y, 50M and 50C except for the black developing unit 50K, the developing units 50Y, 50M and 50C can be installed from "F1" direction and also, can achieve the feeding angle (e) of 10 degrees in such a way rear ends of the developing units 50Y, 50M and 50C are tilted 10 degrees higher than front ends thereof.

The lowermost black developing unit 50K has a horizontal installation direction "F2", to achieve sufficient interior volume of the developer storage portion 51K and the carrying portion 311K. The black developing unit 50K is internally formed with a developer slope having a same inclination as the feeding angle (e), to allow the developer to be supplied by the same feeding angle (e) as that of other developing units 50Y, 50M and 50C.

As apparent from the above description, various embodiments of the present general inventive concept provides an image forming apparatus, in which a developer unit which forms a developer image for lubrication, has a larger developer storage capacity than a storage capacity of other developing units, so as to maintain proper balance between life spans of the developing units, resulting in enhanced convenience of use.

Further, as a result of locating a developing unit used for a lubricating operation at the farthest downstream side with respect to a rotating direction of an image carrier, various embodiments of the present general inventive concept has an effect of preventing deterioration of a printing speed and contamination of peripheral components.

Furthermore, various embodiments of the present general inventive concept has the effect of preventing deterioration of image quality caused when residual developer falls or is scattered to contaminate an interior of a developing unit or an interior of a light window.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. An image forming apparatus, comprising: an image carrier; and plural developing units arranged along a rotating direction of the image carrier, to supply developer to the image carrier, wherein the plural developing units include a first developing unit having a largest developer storage capacity and a second developing unit disposed at the farthest downstream side with respect to the rotating direction of the image carrier, the second developing unit having a developer storage capacity smaller than the developer storage capacity of the first developing unit and larger than a developer storage capacity of the remaining developing units; wherein the developing units respectively include developing members, and one or more developing units respectively include carrying portions protruding from the developing members toward the image carrier, to receive the developer therein.

2. The image forming apparatus according to claim 1, wherein at least one of the carrying portions has a different protruding length than the remaining carrying portions protruding toward the image carrier.

3. The image forming apparatus according to claim 2, wherein the carrying portion of the developing unit, disposed at the farthest upstream side with respect to the rotating direction of the image carrier, protrudes the farthest toward the image carrier.

4. The image forming apparatus according to claim 1, wherein at least one of front surface portions of the carrying portions, which is closest to the image carrier, is bent upward along the contour of an outer circumferential surface of the image carrier.

5. The image forming apparatus according to claim 1, wherein the developing units respectively further include feeding members to supply the developer to the developing members, and the carrying portions respectively include developer shields provided along a longitudinal direction of the developing members, each developer shield having one side fixed to the corresponding carrying portion and an other side adjacent to one of the corresponding developing and feeding members.

6. The image forming apparatus according to claim 5, wherein the developer shields are tilted toward the rotating direction of the developing members.

7. The image forming apparatus according to claim 1, wherein the developer is supplied to the image carrier by a feeding angle that is an acute angle relative to a horizontal plane.

8. The image forming apparatus according to claim 7, wherein at least one of the developing units is tilted by the feeding angle, to supply the developer by the feeding angle.

9. The image forming apparatus according to claim 8, wherein the feeding angle is less than half of an angle of repose of the developer.

10. The image forming apparatus according to claim 9, wherein the feeding angle is substantially 10 degrees.

11. An image forming apparatus, comprising: a photosensitive member; a light scanning device to scan light to the photosensitive member so as to form an electrostatic latent image; and plural developing units arranged along a rotating direction of the photosensitive member, wherein the plural developing units include a first developing unit including a developer storage portion having a first volume, a second developing unit including a developer storage portion having a second volume less than the first volume, and at least one third developing unit including a developer storage portion having a third volume less than the second volume, and the second developing unit is disposed at the farthest downstream side with respect to the rotating direction of the photosensitive member wherein one or more developing units of the first, second and third developing units respectively include carrying portions protruding toward the image carrier to receive residual developer not attached to the photosensitive member therein.

12. The image forming apparatus according to claim 11, wherein at least one of the carrying portions has a different protruding length than the remaining carrying portions protruding toward the image carrier.

13. The image forming apparatus according to claim 12, wherein the carrying portion of the developing unit, disposed at the farthest upstream side with respect to the rotating direction of the photosensitive member, protrudes the farthest toward the photosensitive member.

14. The image forming apparatus according to claim 11, wherein the developing units respectively include developing members to attach the developer to the photosensitive member, and the carrying portions respectively include developer shields provided along a longitudinal direction of the developing members, each developer shield having one side fixed to the corresponding carrying portion and an other side adjacent to the corresponding developing member.

15. The image forming apparatus according to claim 11, wherein at least one of the first, second and third developing units is provided to supply the developer to the photosensitive member by a feeding angle that is an acute angle relative to a horizontal plane.

16. The image forming apparatus according to claim 15, wherein the feeding angle is less than half of an angle of repose of the developer.

17. The image forming apparatus according to claim 15, wherein the feeding angle is substantially 10 degrees.

18. An image forming apparatus, comprising:

plural developing units arranged parallel and adjacent to one another along a rotating direction of an image carrier, at least one of the developing units having a different developer storage capacity from the developer storage capacity of the remaining developing units; and carrying portions provided at the respective developing units, to receive residual developer, not attached to the image carrier, wherein the farthest upstream carrying portion, formed at one of the developing units disposed at the farthest upstream side with respect to the rotating direction of the image carrier, protrudes the farthest toward the image carrier than the carrying portions formed at the remaining developing units.

19. An image forming apparatus, comprising:

plural developing units arranged parallel and adjacent to one another along a rotating direction of an image carrier and respectively including developing members to attach developers to the image carrier, at least one of the developing units having a different developer storage capacity; and carrying portions integrally formed with the developing units at positions underneath the developing members, to receive residual developers not attached to the image carrier therein.

20. The image forming apparatus according to claim 19, wherein at least one of the carrying portions formed at the respective developing units has a different protruding length than the remaining carrying portions protruding toward the image carrier.

21. The image forming apparatus according to claim 20, wherein the carrying portion of the developing unit, disposed at the farthest upstream side with respect to the rotating, direction of the image carrier, protrudes the farthest toward the image carrier.

22. The image forming apparatus according to claim 19, further comprising:

developer shields provided along a longitudinal direction of the developing members and tilted toward a rotating direction of the developing members, each developer shield having one side fixed to the corresponding carrying portion and an other side adjacent to the corresponding developing member.

23. A developing unit usable with an image forming apparatus, the developing unit comprising:

a developer storage capacity smaller than a developer storage capacity of a first developing unit provided to supply black developer to an image carrier and larger than a developer storage capacity of a second developing unit provided to supply second-color developer to the image carrier, wherein the developing unit is disposed at the farthest downstream side of the first and second developing units arranged parallel and adjacent to one another along a rotating direction of the image carrier, and provided to supply first-color developer to the image carrier.

24. The developing unit according to claim 23, wherein the developing unit is configured to supply the developer to the image carrier by a feeding angle that is an acute angle less than half of an angle of repose of the developer relative to a horizontal plane.

25. The image forming apparatus according to claim 24, wherein the feeding angle is substantially 10 degrees.

26. A developing unit to store black developer usable with an image forming apparatus having first and second developing units arranged parallel and adjacent to one another other along a rotating direction of an image carrier, the developing unit comprising:

a developer storage capacity larger than a developer storage capacity of the first developing unit, the developer storage capacity of the developing unit is larger than a developer storage capacity of a second developing unit disposed at the farthest downstream side with respect to the rotating direction of the image carrier, wherein the developing unit is disposed upstream of a first developing unit provided to supply first-color developer to the image carrier.

27. A developing unit usable with an image forming apparatus, the developing unit comprising:

a developing unit housing;

a developer storage portion provided in the developing unit housing;

a developing member to attach developer received in the developer storage portion to an image carrier; and a carrying portion provided underneath the developing member and extending to the front side of the developing unit housing so as not to interfere with the image carrier, the carrying portion receiving residual developer not attached to the image carrier by the developing member.

28. A developing unit usable with an image forming apparatus, the developing unit comprising:

a developing unit housing;

a developer storage portion provided in the developing unit housing;

a developing member to attach developer received in the developer storage portion to an image carrier;

a carrying portion provided underneath the developing member and extending to the front side of the developing unit housing so as not to interfere with the image carrier, the carrying portion receiving residual developer not attached to the image carrier by the developing member; and a developer shield provided along a longitudinal direction of the developing member and having one side fixed to the carrying portion and an other side adjacent to the developing member.

29. An image forming apparatus, comprising:

plural developing units arranged parallel and adjacent to one another other along a rotating direction of an image carrier, at least one of the developing units having a different developer storage capacity, wherein each developing unit is provided to supply the developer to the image carrier by a feeding angle that is an acute angle less than half of an angle of repose of the developer relative to a horizontal plane.

30. The image forming apparatus according to claim 29, wherein the feeding angle is substantially 10 degrees.

31. An image forming apparatus, comprising:

an image carrier having a rotating direction; and a plurality of developing units having developer storage capacities and carrying portions to receive residual developer, wherein one of the plurality of developing units disposed at the farthest upstream side with respect to the rotating direction of the image carrier has a respective developer storage capacity more than at least one of the remaining developing units, and a respective carrying portion that protrudes toward the image carrier more than other carrying portions of the remaining developing units.

* * * * *